US007438536B2

(12) United States Patent
Ito

(10) Patent No.: US 7,438,536 B2
(45) Date of Patent: Oct. 21, 2008

(54) COMPRESSORS INCLUDING A PLURALITY OF OIL STORAGE CHAMBERS WHICH ARE IN FLUID COMMUNICATION WITH EACH OTHER

(75) Inventor: Kiyofumi Ito, Isesaki (JP)

(73) Assignee: Sanden Corproation, Gunma (JP)

( * ) Notice: Subject to any disclaimer, the term of this patent is extended or adjusted under 35 U.S.C. 154(b) by 278 days.

(21) Appl. No.: 11/004,123

(22) Filed: Dec. 6, 2004

(65) Prior Publication Data

US 2005/0129556 A1 Jun. 16, 2005

(30) Foreign Application Priority Data

Dec. 10, 2003 (JP) ..... 2003/412182

(51) Int. Cl.
*F04B 39/02* (2006.01)
*F04B 39/06* (2006.01)

(52) U.S. Cl. ..... 417/312; 417/410.5; 418/55.6

(58) Field of Classification Search ..... 417/366, 417/410.5, 312, 269, 222.2; 166/68; 418/55.6
See application file for complete search history.

(56) References Cited

U.S. PATENT DOCUMENTS

| | | | | |
|---|---|---|---|---|
| 1,405,259 | A | 1/1922 | Beach | |
| 1,854,692 | A | 4/1932 | Cooper | |
| 3,317,123 | A | 5/1967 | Funke | |
| 3,499,270 | A | 3/1970 | Paugh | |
| 3,684,412 | A | 8/1972 | Harlin et al. | |
| 3,850,009 | A | 11/1974 | Villadsen | |
| 4,332,535 | A | 6/1982 | Terauchi et al. | |
| 4,343,599 | A | 8/1982 | Kousokabe | |
| 4,360,321 | A | 11/1982 | Copp, Jr. et al. | |
| 4,390,061 | A * | 6/1983 | Short | 166/53 |
| 4,470,778 | A | 9/1984 | Mabe | |
| 4,496,293 | A | 1/1985 | Nakamura et al. | |
| 4,547,138 | A | 10/1985 | Mabe et al. | |
| 4,666,381 | A | 5/1987 | Butterworth | |
| 4,892,469 | A | 1/1990 | McCullough et al. | |
| 5,271,245 | A | 12/1993 | Westermeyer | |
| 5,395,224 | A | 3/1995 | Caillat et al. | |

(Continued)

FOREIGN PATENT DOCUMENTS

DE 2822780 12/1978

(Continued)

*Primary Examiner*—Charles G Freay
*Assistant Examiner*—Patrick Hamo
(74) *Attorney, Agent, or Firm*—Baker Botts, LLP

(57) ABSTRACT

The present invention provides a compressor capable of supplying a lubricating oil stably to the refrigerant suction side of a compression section even if a lubricating oil is discharged into an oil storage chamber with great force. In this compressor, the oil storage chamber is provided so that two chambers of a first oil storage chamber and a second oil storage chamber communicate with each other, the lubricating oil discharged from a separation chamber is received by the first oil storage chamber, and the lubricating oil is supplied from the second oil storage chamber to the refrigerant suction side of the compression section. Therefore, even if the oil surface of the first oil storage chamber is disturbed by the force of the lubricating oil discharged from the separation chamber, the lubricating oil can always be supplied stably without hindrance to the supply of lubricating oil to the refrigerant suction side of the compression section.

5 Claims, 7 Drawing Sheets

U.S. PATENT DOCUMENTS

| | | | | |
|---|---|---|---|---|
| 5,421,708 | A | 6/1995 | Utter et al. | |
| 5,556,265 | A | 9/1996 | Michiyuki et al. | |
| 5,733,107 | A | 3/1998 | Ikeda et al. | |
| 5,800,133 | A | 9/1998 | Ikeda et al. | |
| 6,010,320 | A | 1/2000 | Kwon | |
| 6,017,205 | A | 1/2000 | Weatherston et al. | |
| 6,074,186 | A | 6/2000 | Lifson et al. | |
| 6,152,713 | A * | 11/2000 | Hisanaga et al. | 418/55.2 |
| 6,227,831 | B1 | 5/2001 | Osima et al. | |
| 6,322,339 | B1 | 11/2001 | Mitsunaga et al. | |
| 6,454,538 | B1 | 9/2002 | Witham et al. | |
| 6,485,535 | B1 | 11/2002 | Linnersten et al. | |
| 6,511,530 | B2 | 1/2003 | Iwanami et al. | |
| 6,755,632 | B1 | 6/2004 | Ito et al. | |
| 7,101,160 | B2 | 9/2006 | Gennami et al. | |
| 2001/0018025 | A1 | 8/2001 | Sakai et al. | |
| 2002/0134101 | A1 | 9/2002 | Gennami et al. | |
| 2003/0152473 | A1 * | 8/2003 | Ito et al. | 418/55.6 |
| 2005/0226756 | A1 | 10/2005 | Ito | |
| 2005/0265878 | A1 | 12/2005 | Ishida | |
| 2005/0271534 | A1 | 12/2005 | Yokoyama | |
| 2006/0065012 | A1 | 3/2006 | Kudo | |

FOREIGN PATENT DOCUMENTS

| | | | |
|---|---|---|---|
| EP | 0317900 | | 5/1989 |
| JP | H54-047110 | A | 4/1979 |
| JP | H57-143187 | A | 9/1982 |
| JP | 61205386 | | 9/1986 |
| JP | 6316190 | | 1/1988 |
| JP | H63-106393 | A | 5/1988 |
| JP | 07151083 | | 6/1995 |
| JP | H11-082352 | A | 3/1999 |
| JP | 2000-170681 | A | 6/2000 |
| JP | 2001-295767 | A | 10/2001 |
| JP | 2003-129975 | A | 5/2003 |
| WO | WO8505403 | | 12/1985 |
| WO | WO8600369 | | 1/1986 |

* cited by examiner

COMPRESSORS INCLUDING A PLURALITY OF OIL STORAGE CHAMBERS WHICH ARE IN FLUID COMMUNICATION WITH EACH OTHER

BACKGROUND OF THE INVENTION (i) Field of the Invention

The present invention relates to a compressor used to compress a refrigerant for, for example, a vehicular air conditioner.

(ii) Description of the Related Art

Conventionally, a compressor of this type includes a compressor body, a compression section for compressing a refrigerant sucked into the compressor body, a separation chamber for separating a lubricating oil, which is contained in the refrigerant discharged from the compression section, from the refrigerant, and an oil storage chamber for receiving the separated lubricating oil and supplying the lubricating oil to the refrigerant suction side of the compression section. Thereby, the refrigerant compressed together with the lubricating oil in the compression section in the compressor body is separated into refrigerant and lubricating oil in the separation chamber, the lubricating oil is stored in the oil storage chamber, and the refrigerant is discharged to the outside of the compressor body.

However, in the conventional compressor, the separated lubricating oil is discharged vertically toward the oil surface of lubricating oil in the oil storage chamber through an introduction hole provided in the lower surface of the separation chamber. Therefore, the lubricating oil in the oil storage chamber is agitated by the force of the discharged lubricating oil, by which the refrigerant turns to air bubbles and is supplied to the refrigerant suction side of the compression section, which may result in a decrease in efficiency of compressor.

SUMMARY OF THE INVENTION

An object of the present invention is to provide a compressor capable of supplying a lubricating oil stably to the refrigerant suction side of a compression section even if a lubricating oil is discharged into an oil storage chamber with great force.

To achieve the above object, the present invention provides a compressor comprising a compressor body; a compression section for compressing a refrigerant sucked in the compressor body; a separation chamber for separating a lubricating oil, which is contained in the refrigerant discharged from the compression section, from the refrigerant; a first oil storage chamber for receiving the lubricating oil discharged from the separation chamber; a second oil storage chamber for storing the lubricating oil to be supplied to the refrigerant suction side of the compression section; and a lower communication path for connecting lower parts of the first oil storage chamber and the second oil storage chamber to each other.

Thereby, the lubricating oil discharged from the separation chamber is received by the first oil storage chamber, and the lubricating oil in the second oil storage chamber is supplied to the refrigerant suction side of the compression section, so that even if the oil surface of the first oil storage chamber is disturbed by the force of the lubricating oil discharged from the separation chamber, the lubricating oil is supplied to the refrigerant supply side of the compression section without the oil surface of the second oil storage chamber being disturbed. Therefore, even if the oil surface of the first oil storage chamber is disturbed by the force of the lubricating oil discharged from the separation chamber, the oil surface of the second oil storage chamber is not disturbed and therefore, the lubricating oil can always be supplied stably without hindrance to the supply of lubricating oil to the refrigerant suction side of the compression section.

These and other objects, features, and advantages of the present invention will become more apparent in the detailed description and accompanying drawings which follow.

DESCRIPTION OF THE PREFERRED EMBODIMENTS

Figure 1:
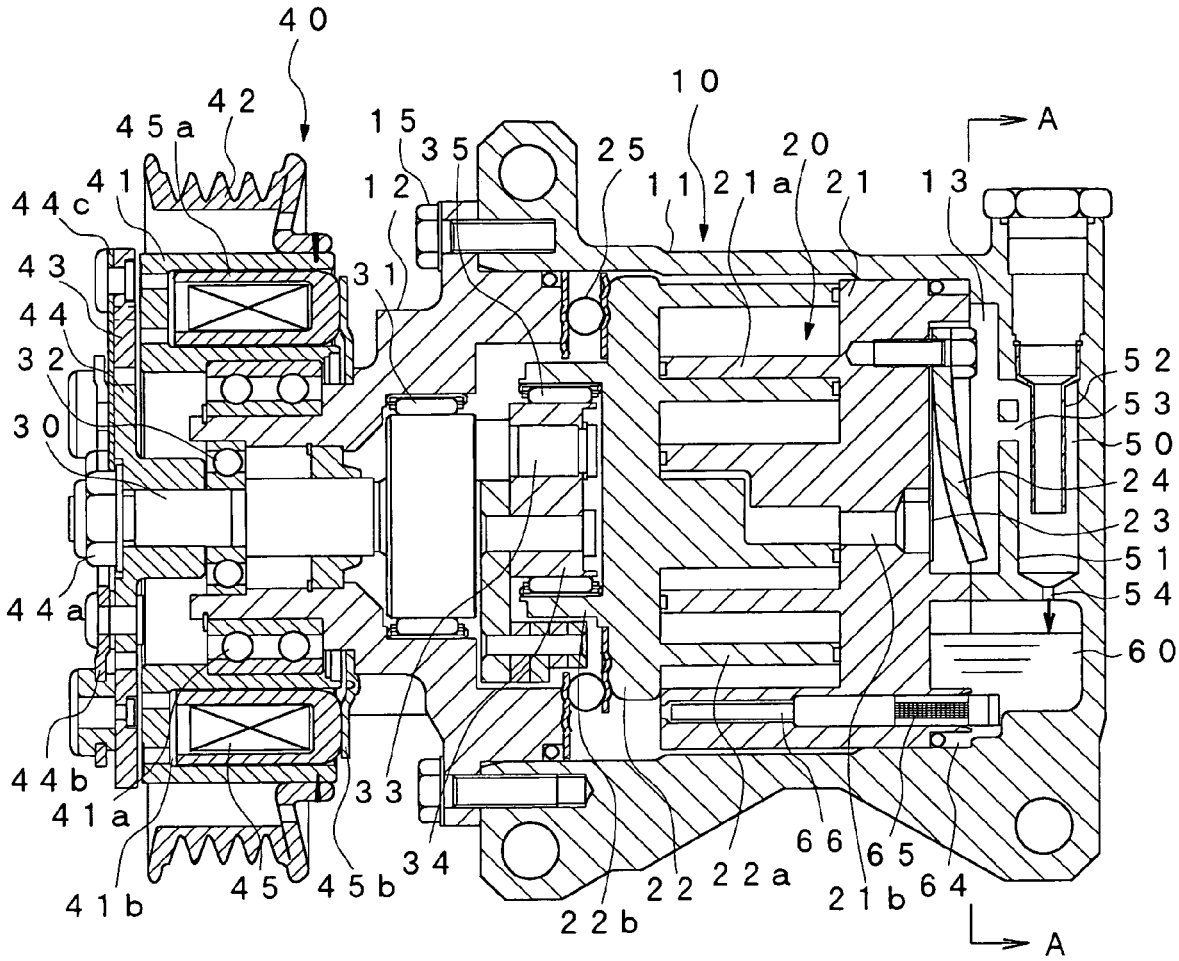
FIG. 1 is a sectional view of a compressor in accordance with a first embodiment of the present invention, taken along the line B-B of FIG. 2.
Figure 2:
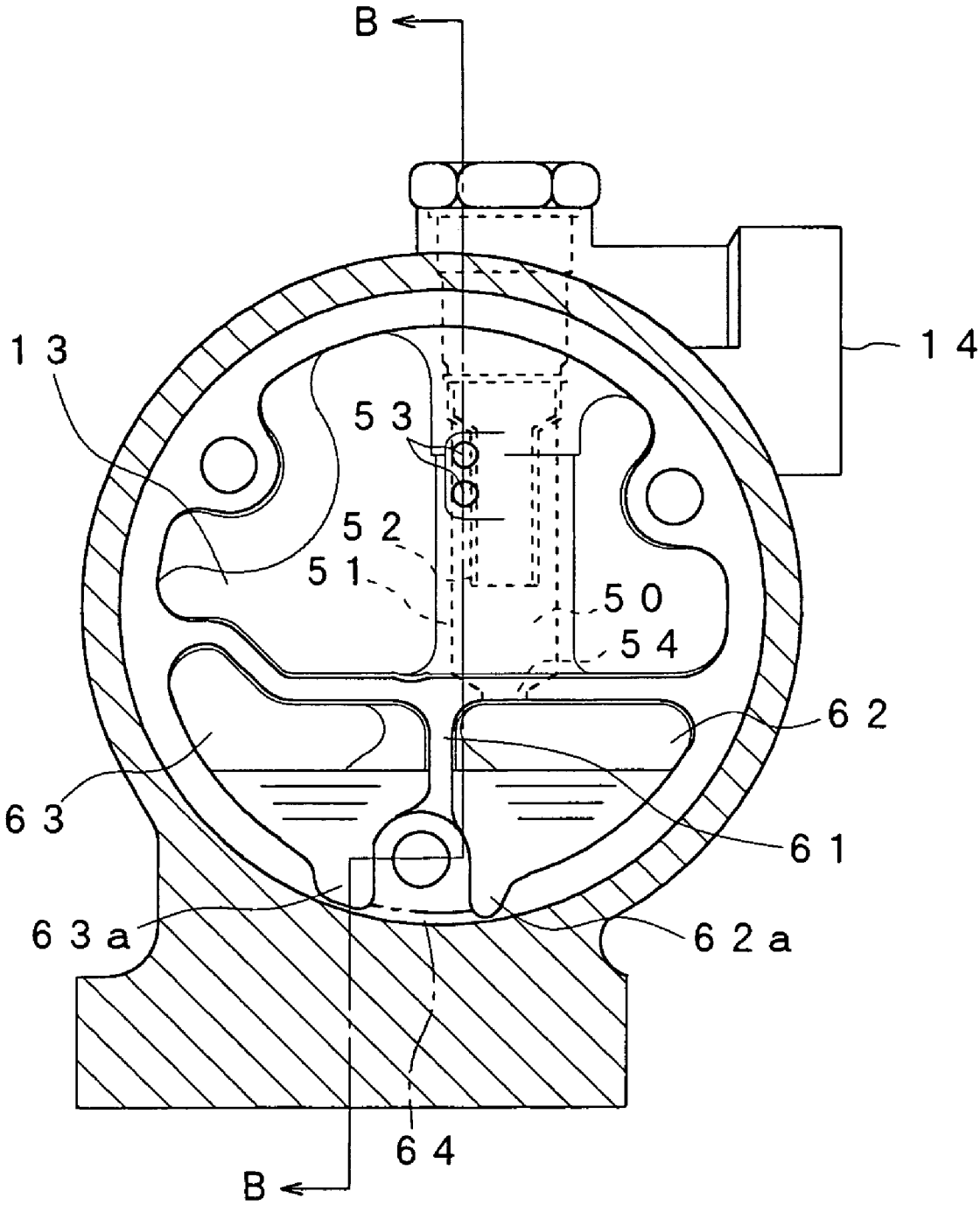
FIG. 2 is a sectional view taken along the line A-A of the compressor shown in FIG. 1.

FIGS. 1 to 5 show a first embodiment of the present invention.

A compressor of this embodiment includes a compressor body 10, a compression section 20 for compressing a refrigerant sucked into the compressor body 10, a drive shaft 30 for driving the compression section 20, an electromagnetic clutch 40 for transmitting power supplied from the outside to the drive shaft 30, a separation chamber 50 for separating a lubricating oil, which is contained in the refrigerant discharged from the compression section 20, from the refrigerant, and a oil storage chamber 60 for storing the separated lubricating oil and supplying it to the refrigerant suction side of the compression section 20.

The compressor body 10 is formed in a hollow shape, and consists of a first housing 11 and a second housing 12. The first housing 11 forms one end surface and the side surface of the compressor body 10, and a refrigerant discharge chamber 13 is provided on one end side of the interior of the first housing 11. Also, a refrigerant suction port, not shown, is provided in the side surface of the first housing 11, and a refrigerant discharge port 14 is provided in the side surface on one end surface side. The second housing 12 forms the other end surface side of the compressor body 10, and is fixed to the first housing 11 by bolts 15.

The compression section 20 consists of a fixed scroll member 21 arranged on one end side in the first housing 11 and a movable scroll member 22 arranged on the other end side in the first housing 11, and the fixed scroll member 21 is fixed in the first housing 11 so as to partition the refrigerant discharge chamber 13. One spiral wrap 21*a* is provided on one end surface of the fixed scroll member 21, and a through hole 21*b* communicating with the refrigerant discharge chamber 13 is provided substantially in the center of the fixed scroll member 21. Also, on the other end surface of the fixed scroll member 21 is provided a plate-shaped discharge valve 23 for opening and closing the through hole 21*b*. The discharge valve 23 is configured so as to regulate the opening angle by using a stopper 24 provided on the other end surface of the fixed scroll member 21. The other spiral wrap 22*a* is provided on one end surface of the movable scroll member 22, and on the other end surface of the movable scroll member 22 is provided a boss portion 22*b* extending toward the second housing 12. Also, between the movable scroll member 22 and the second housing 12, a rotation checking mechanism 25 is provided so that the movable scroll member 22 performs orbital motion without rotating by means of the rotation checking mechanism 25.

One end side of the drive shaft 30 is rotatably supported by the second housing 12 via a roller bearing 31, and the other end side thereof is rotatably supported by the second housing 12 via a ball bearing 32. On one end surface of the drive shaft 30, an eccentric pin 33 that is off-centered with respect to the axis is projectingly provided, and the eccentric pin 33 is inserted in an eccentric bush 34. Also, the eccentric bush 34 is rotatably supported by the boss portion 22*b* on the movable scroll member 22 via a roller bearing 35.

The electromagnetic clutch 40 includes a rotor 41 rotating coaxially with the drive shaft 30, a pulley 42 provided integrally with the rotor 41, an armature 43 rotating coaxially with the rotor 41, a hub 44 rotating integrally with the armature 43, and an electromagnetic coil 45 capable of attracting the axial opposed surfaces of the rotor 41 and the armature 43 to each other by means of a magnetic force.

The rotor 41 consists of a magnetic body formed in a ring shape, and the inner peripheral surface thereof is rotatably supported by the second housing 12 of the compressor body 10 via a roller bearing 41*a*. On one end side of the rotor 41 is provided a ring-shaped concave portion 41*b*, and the electromagnetic coil 45 is contained in this concave portion 41*b*. The other end surface of the rotor 41 is opposed to the armature 43 in the axial direction so that the armature 43 is attracted by the electromagnetic coil 45.

The pulley 42 is provided on the outer peripheral surface of the rotor 41, and a V belt, not shown, is set around the pulley 42.

The armature 43 consists of a magnetic body formed by a ring-shaped plate member, and one end surface thereof is opposed to the other end surface of the rotor 41 via a slight gap so as to be attracted to the other end surface of the rotor 41 by the electromagnetic coil 45.

The hub 44 consists of a metallic member formed in a disc shape. To the center thereof is connected one end side of the drive shaft 30, and the drive shaft 30 is fixed to the hub 44 by a nut 44*a*. The hub 44 is connected to the armature 43 via a connecting plate 44*b* and a plate spring 44*c*. The armature 43 can be displaced toward the rotor 41 by the elastic deformation of the plate spring 44*c*.

The electromagnetic coil 45 consists of a winding of an insulating coated conductor, and mold fixed in a stator 45*a* by a resin member such as epoxy resin. The stator 45*a* consists of a magnetic body having a substantially U-shaped cross section, which is formed in a ring shape, and is fixed in the concave portion 41*a* of the rotor 41. Also, the stator 45*a* is connected to the compressor body 10 via a ring-shaped connecting member 45*b*.

The separation chamber 50 is arranged in a refrigerant passage between the refrigerant discharge chamber 13 and the refrigerant discharge port 14, and an inner wall 51 of the separation chamber 50 forms a vertically extending space having a circular cross section. In the separation chamber 50, a separation tube 52 consisting of a member formed in a substantially cylindrical shape is arranged so as to extend vertically. The upper end side of the separation tube 52 is formed so as to be in contact with the inner wall 51 of the separation chamber 50, and the lower end side thereof is formed so as to have a predetermined clearance from the inside wall 51. Also, the lower end of the separation tube 52 is provided so as to be open with a clearance being provided between the lower end of the separation tube 52 and the lower surface of the separation chamber 50. In an upper part on the refrigerant discharge chamber 13 side of the separation chamber 50 are provided a pair of communication holes 53, and in the center of the lower surface of the separation chamber 50 is provided an introduction hole 54 communicating with the oil storage chamber 60. At this time, the communication holes 53 are provided in the tangential direction of the circumference-shaped inner wall 51 at a predetermined distance in the width direction with respect to the center axis of the separation chamber 50 at an interval vertically.

The oil storage chamber 60 is formed between one end side of the first housing 11 and the other end side of the fixed scroll member 21. The oil storage chamber 60 is formed with a first oil storage chamber 62 and a second oil storage chamber 63 by partitioning the oil storage chamber 60 by a partition wall 61 in the right-and-left direction in FIG. 2. In lower parts of the first oil storage chamber 62 and the second oil storage chamber 63, notch portions 62*a* and 63*a* are provided, respectively, by making notches on the first housing 11 side. The first oil storage chamber 62 and the second oil storage chamber 63 communicate with each other via a lower communication path 64, which is a gap formed in a connecting portion between the first housing 11 and the fixed scroll member 21 and extending in the circumferential direction. Also, an upper part of the first oil storage chamber 62 communicates with the separation chamber 50 via the introduction hole 54, and a lower part of the second oil storage chamber 63 communicates with the refrigerant suction side of the compression section 20 via a filter 65 and an orifice 66, which are provided in the fixed scroll member 21.

In the compressor constructed as described above, when the power of an engine is supplied to the pulley 42 of the electromagnetic clutch 40, the rotor 41 rotates integrally with the pulley 42. At this time, when the electromagnetic coil 45 is in a de-energized state, the axial opposed surfaces of the rotor 41 and the armature 43 are held with a gap provided therebetween, and hence the rotor 41 rotates freely with respect to the armature 43, so that the rotating force of the rotor 41 is not transmitted to the armature 43. When the electromagnetic coil is energized, the armature 43 is attracted toward the rotor 41 by the magnetic force of the electromagnetic coil 45, so that the rotor 41 and the armature 43 are pressed on each other and engaged frictionally with each other. Thereby, the rotating force of the rotor 41 is transmitted, so that the rotating force of the armature 43 is transmitted to the drive shaft 30.

When the drive shaft 30 is rotated, the movable scroll member 22 of the compression section 20 performs a predetermined orbiting motion by means of the rotation of the eccentric bush 34. Thereby, the refrigerant flowing into the first housing 11 through the refrigerant suction port of the compressor body 10 is sucked to between the spiral wrap 22*a* of the movable scroll member 22 and the spiral wrap 21*a* of the fixed scroll member 21, and is compressed between the spiral wraps 21*a* and 22*a*. The detailed explanation of the compressing operation of the spiral wraps 21*a* and 22*a* is omitted because this compressing operation is the same as that of the publicly known scroll compressor.

The compressed refrigerant is discharged into the refrigerant discharge chamber 13, and is discharged from the refrigerant discharge chamber 13 into the separation chamber 50 via the communication holes 53. Since the communication holes 53 are arranged in the tangential direction of the inner wall 51 at a predetermined distance in the width direction with with respect to the center axis of the separation chamber 50, the compressed refrigerant lowers while swirling along the inner wall 51 of the separation chamber 50. At this time, the compressed refrigerant contains the lubricating oil. By swirling the compressed refrigerant along the inner wall 51 of the separation chamber 50, the lubricating oil adheres to the inner wall 51 of the separation chamber 50 and is separated from the refrigerant. The refrigerant from which the lubricating oil is separated is discharged from the lower end of the separation tube 52 to the outside through the refrigerant discharge port 14. The lubricating oil lowers by means of the gravity, and is discharged into the oil storage chamber 60 via the introduction hole 54 in the lower part of the separation chamber 50.

Figure 3:
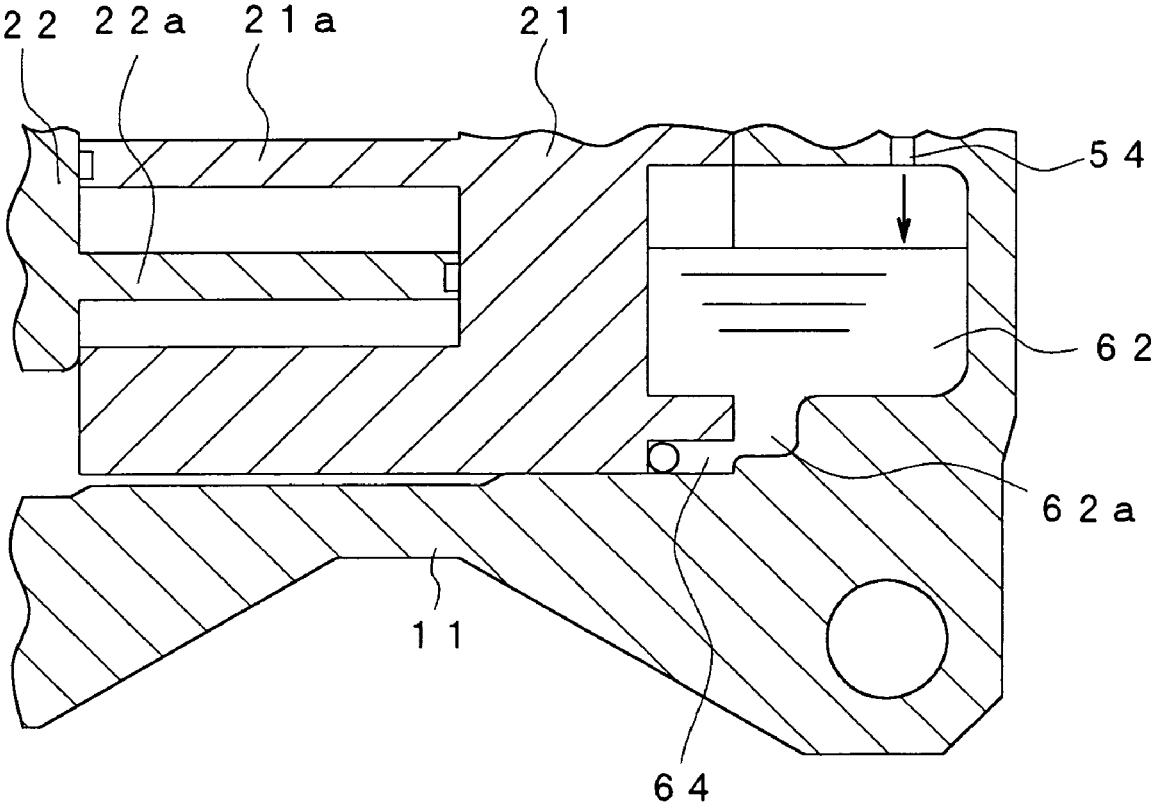
FIG. 3 is a side sectional view of an essential portion of a compressor, showing a first oil storage chamber.
Figure 4:
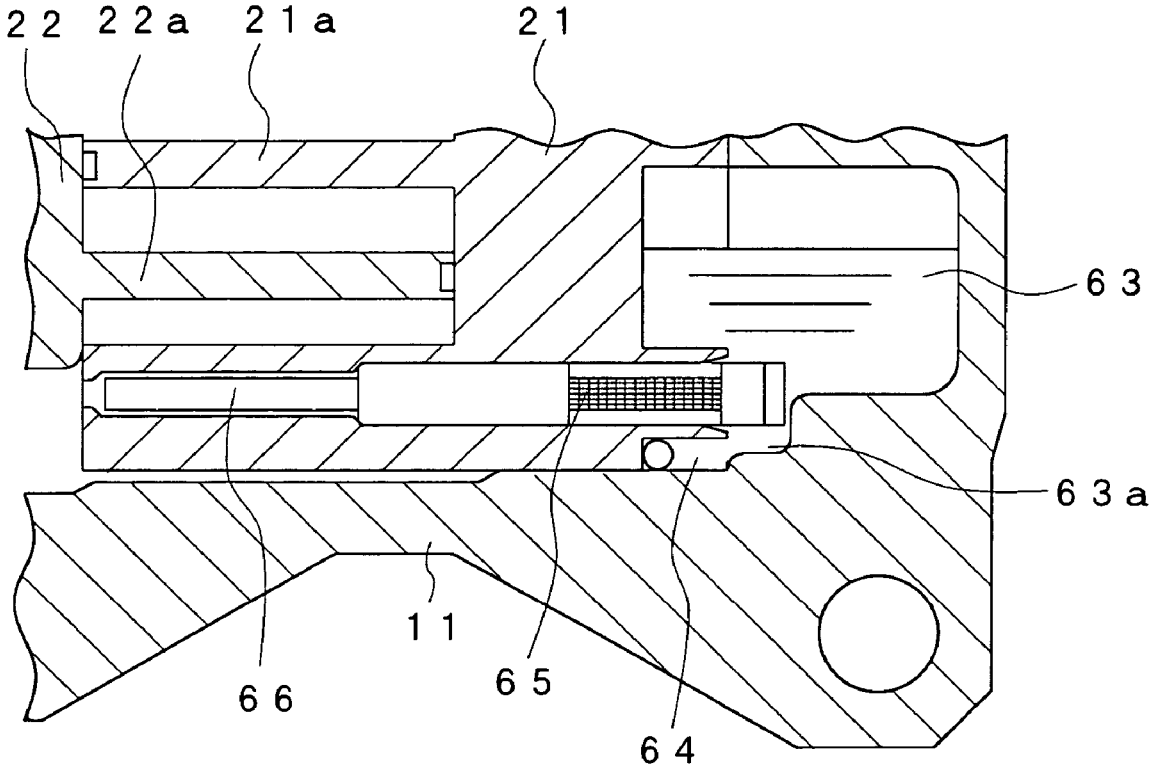
FIG. 4 is a side sectional view of an essential portion of a compressor, showing a second oil storage chamber.
Figure 5:
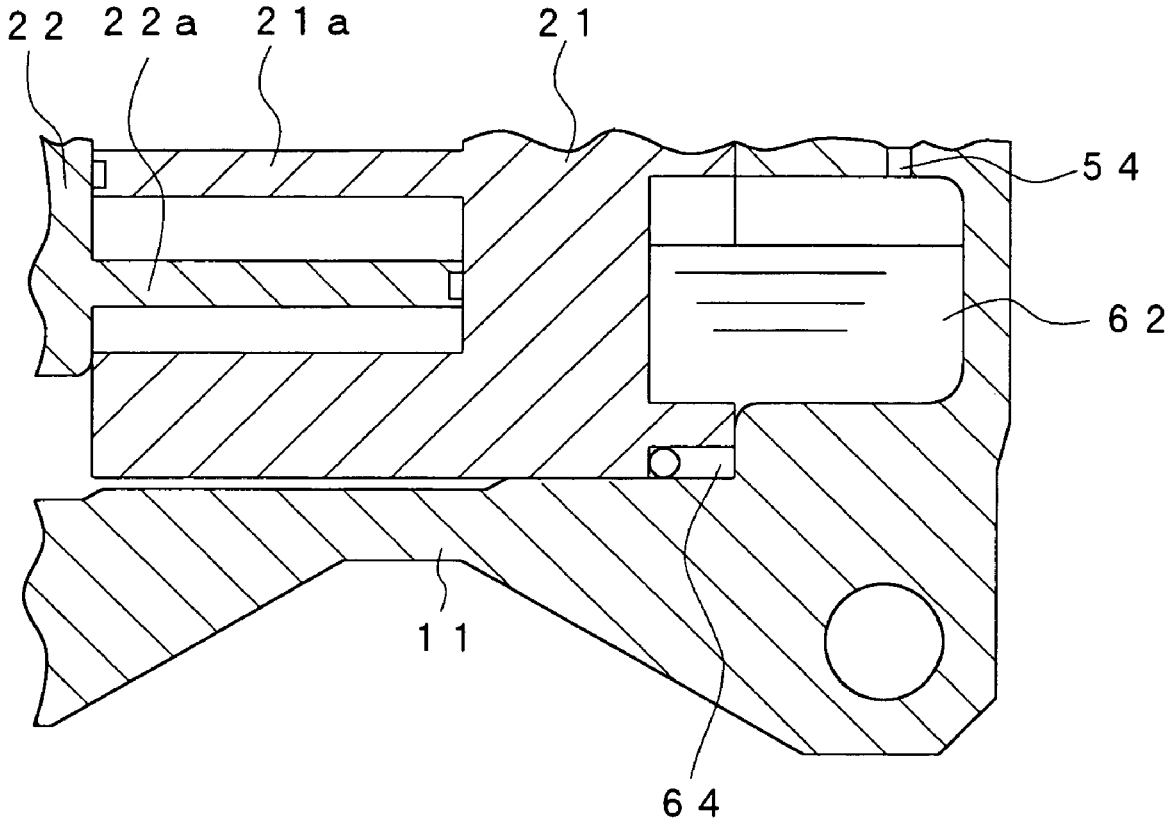
FIG. 5 is a side sectional view of an essential portion of a compressor, showing a lower communication path.

The lubricating oil discharged from the separation section 50 flows into the first oil storage chamber 62 of the oil storage chamber 20 and flows into the second oil storage chamber 63 via the lower communication path 64. The lubricating oil flowing into the second oil storage chamber 63 is attracted to the refrigerant suction side of the compression section 20 by a difference in internal pressure between the refrigerant suction side of the compression section 20 and the second oil storage chamber 63. After impurities are removed from the lubricating oil by the filter 65, the supply amount of lubricating oil is regulated by the orifice 66, and the lubricating oil is supplied to the refrigerant suction side of the compression section 20. At this time, as shown in FIGS. 3 to 5, since the oil storage chamber 60 is divided, by the partition wall 61, into the first oil storage chamber 62 into which the lubricating oil is discharged from the separation chamber 50 and the second oil storage chamber 63 from which the lubricating oil is supplied to the refrigerant suction side of the compression section 20, even if the oil surface of the first oil storage chamber 62 is disturbed by the force of the lubricating oil discharged from the separation chamber 50, the lubricating oil is stored without the oil surface of the second oil storage chamber 63 being disturbed. Therefore, the lubricating oil can always be supplied stably to the refrigerant suction side of the compression section 20.

Thus, according to the compressor of this embodiment, the oil storage chamber 60 is provided so that two chambers of the first oil storage chamber 62 and the second oil storage chamber 63 communicate with each other, the lubricating oil discharged from the separation chamber 50 is received by the first oil storage chamber 62, and the lubricating oil is supplied from the second oil storage chamber 63 to the refrigerant suction side of the compression section 20. Therefore, even if the oil surface of the first oil storage chamber 62 is disturbed by the force of the lubricating oil discharged from the separation chamber 50, the lubricating oil can always be supplied stably without hindrance to the supply of lubricating oil to the refrigerant suction side of the compression section 20.

Also, since the lubricating oil is supplied from the oil storage chamber 63 to the refrigerant suction side of the compression section 20 via the orifice 66, the supply amount of lubricating oil can be made proper, so that the lubricating oil can always be supplied stably.

Also, since the filter 65 is provided on the second oil storage chamber side of the orifice 66, the impurities contained in the lubricating oil can be trapped by the filter 65, so that the clogging of the orifice 66 can be prevented.

Figure 6:
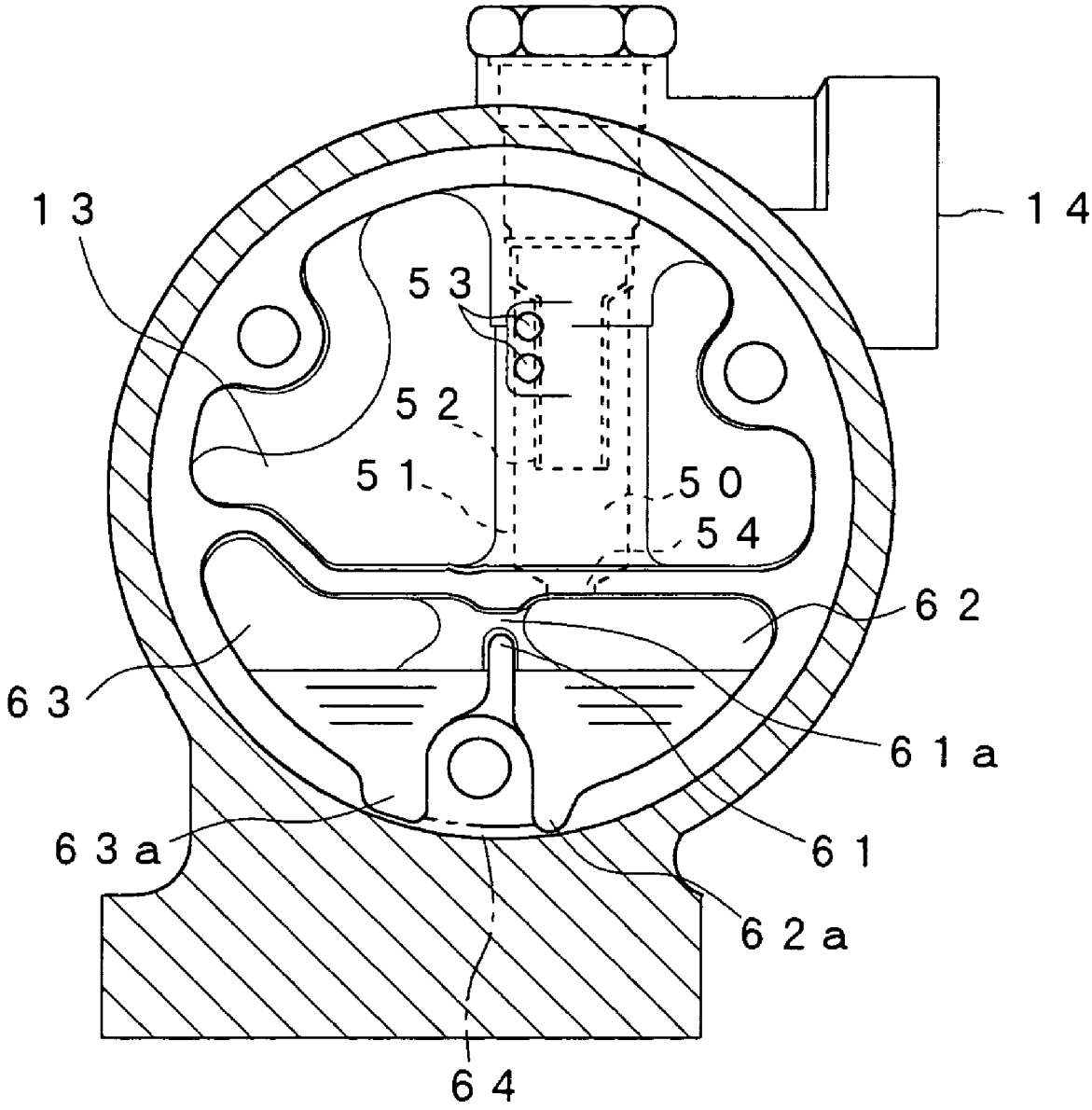
FIG. 6 is a front sectional view of a compressor in accordance with a second embodiment of the present invention.
Figure 7:
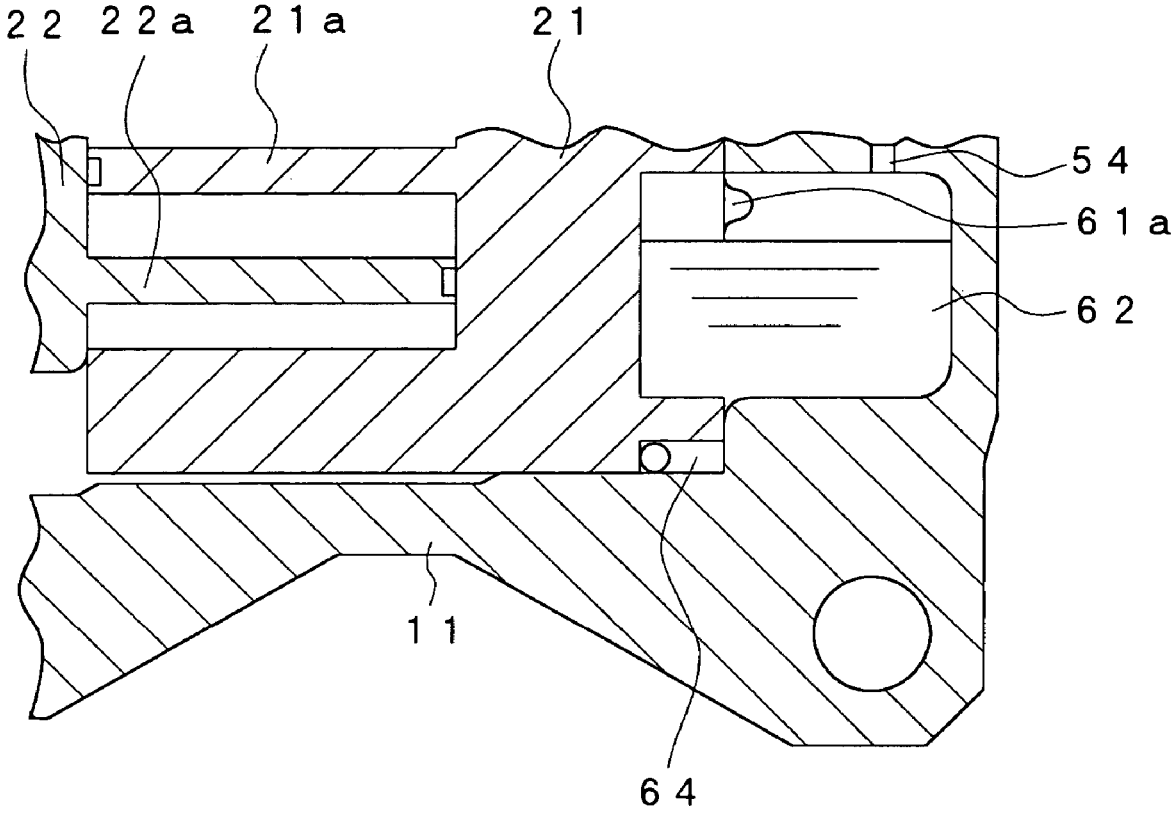
FIG. 7 is a side sectional view of an essential portion of a compressor, showing a first oil storage chamber.

FIGS. 6 and 7 show a second embodiment of the present invention. In FIGS. 6 and 7, the same reference numerals are applied to elements equivalent to those in the first embodiment.

In the compressor of this embodiment, the upper spaces of the first oil storage chamber 62 and the second oil storage chamber 63 are connected to each other by a notch portion 61*a*, which is an upper communication path provided by cutting out the first housing 11 located on the upper side of the partition wall 61 provided between the first oil storage chamber 62 and the second oil storage chamber 63.

At the operation time of this compressor, even in a state in which the lubricating oil is stored in the first oil storage chamber 62 and the second oil storage chamber 63, since the upper spaces in the first and second oil storage chambers 62 and 63 are connected to each other by the notch portion 61*a*, the refrigerant accumulating in the upper part of the second oil storage chamber 63 is caused to flow to the first oil storage chamber 62, by which the pressures in the oil storage chambers 62 and 63 can be kept equal without a decrease in storage amount of the lubricating oil.

Thus, according to the compressor of this embodiment, since the upper spaces of the first oil storage chamber 62 and the second oil storage chamber 63 are connected to each other by providing the notch portion 61*a* in the partition wall 61 between the oil storage chambers 62 and 63, the pressures in the oil storage chambers 62 and 63 can be kept equal, and hence the lubricating oil can surely be supplied to the refrigerant suction side of the compression section 20 with the oil surfaces of the first oil storage chamber 62 and the second oil storage chamber 63 being at the same level.

The preferred embodiments described in this specification are typical examples, and the present invention is not limited to the above-described embodiments. The scope of the invention is shown in the appended claims, and all changes and modifications included in the meaning of these claims are embraced in the present invention.

What is claimed is:

1. A compressor comprising:

a compressor body;

a compression section for compressing a refrigerant sucked in said compressor body;

a separation chamber for separating a lubricating oil, which is contained in the refrigerant discharged from said compression section, from the refrigerant;

a first oil storage chamber for receiving the lubricating oil discharged from said separation chamber;

a second oil storage chamber for storing the lubricating oil to be supplied to the refrigerant suction side of said compression section;

a partition member separating the first oil storage chamber from the second oil storage chamber; and a lower communication path for connecting lower parts of said first oil storage chamber and said second oil storage chamber to each other, wherein an orifice is provided to regulate the flow rate of lubricating oil supplied from said second oil storage chamber to the refrigerant suction side of said compression section.

2. The compressor according to claim 1, wherein an upper communication path is provided to connect upper spaces of said first oil storage chamber and said second oil storage chamber to each other.

3. The compressor according to claim 2, wherein an orifice is provided to regulate the flow rate of lubricating oil supplied from said second oil storage chamber to the refrigerant suction side of said compression section.

4. The compressor according to claim 1, wherein a filter is provided between said orifice and said second oil storage chamber.

5. The compressor according to claim 3, wherein a filter is provided between said orifice and said second oil storage chamber.

* * * * *